US007918695B2

(12) United States Patent
Kutsuna

(10) Patent No.: US 7,918,695 B2
(45) Date of Patent: Apr. 5, 2011

(54) TUBULAR FEMALE TERMINAL FOR RECEIVING A MALE TERMINAL

(75) Inventor: Yoji Kutsuna, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/470,245

(22) Filed: May 21, 2009

(65) Prior Publication Data

US 2009/0291600 A1 Nov. 26, 2009

(30) Foreign Application Priority Data

May 22, 2008 (JP) ..... 2008-134540

(51) Int. Cl.
*H01R 13/187* (2006.01)

(52) U.S. Cl. ..... 439/845; 439/852

(58) Field of Classification Search ..... 439/852, 439/748, 851, 845, 843
See application file for complete search history.

(56) References Cited

U.S. PATENT DOCUMENTS

| | | | | |
|---|---|---|---|---|
| 3,706,954 | A | 12/1972 | Krafthefer | |
| 4,582,380 | A | 4/1986 | Wider et al. | |
| 5,536,186 | A | 7/1996 | Watanabe | |
| 5,634,825 | A * | 6/1997 | Maki | 439/745 |
| 5,679,034 | A * | 10/1997 | Hanazaki et al. | 439/845 |
| 5,733,144 | A | 3/1998 | Tsuji et al. | |
| 5,810,627 | A * | 9/1998 | Gierut et al. | 439/843 |
| 5,899,764 | A | 5/1999 | Harting et al. | |
| 6,139,376 | A | 10/2000 | Ooya et al. | |
| 6,761,597 | B2 | 7/2004 | Shimizu | |
| 7,118,428 | B2 | 10/2006 | Gamaggio et al. | |
| 7,172,471 | B2 | 2/2007 | Bommersheim | |
| 7,207,850 | B2 * | 4/2007 | Takayama | 439/852 |
| 7,387,548 | B2 * | 6/2008 | Takehara et al. | 439/843 |
| 7,697,989 | B1 * | 4/2010 | Lim et al. | 607/36 |

FOREIGN PATENT DOCUMENTS

| | | | |
|---|---|---|---|
| CH | 493949 | A | 8/1970 |
| DE | 1011957 | B | 7/1957 |
| DE | 19718231 | C1 | 9/1998 |
| DE | 20304748 | U1 | 9/2004 |
| EP | 0877390 | A2 | 5/1998 |
| JP | 8-321345 | A | 12/1996 |
| JP | 2003-59565 | A | 7/2004 |

OTHER PUBLICATIONS

German Office Action issued on Jun. 16, 2010, in corresponding German patent application 102009022173.5.

* cited by examiner

*Primary Examiner* — Javaid Nasri
(74) *Attorney, Agent, or Firm* — Sughrue Mion, PLLC

(57) ABSTRACT

A female terminal for receiving a male terminal is provided. The female terminal includes: a tubular box part having a receiving portion for receiving the male terminal therein; a spring piece which includes a fixed end provided inside the box part, and a free end pinching the male terminal between the spring piece and the box part by an elastic reaction force of the spring piece. The spring piece is made of a metal as a separate member from the box part.

10 Claims, 7 Drawing Sheets

TUBULAR FEMALE TERMINAL FOR RECEIVING A MALE TERMINAL

BACKGROUND OF THE INVENTION

1. Technical Field

The present invention relates to a female terminal which includes a tubular box part having a spring piece therein for receiving a mate terminal from a front end of the tubular box part.

2. Background Art

FIG. 7 shows a construction of a female terminal for a general connector described in JP-8-321345A and JP-2003-59565A. The female terminal is integrally formed by press working a single piece of a metal plate. The female terminal includes a tubular box part 510 for inserting a male terminal at a front side, and includes a wire connection portion such as a conductor crimping portion and a sheath crimping portion at a rear side.

Inside the box part 510, a spring piece 520 is provided to pinch the male terminal between an inner wall of the box part 510 and the spring piece 520 by an elastic reaction force when the male terminal is inserted from the front end of the box part 510. The spring piece 520 is formed generally by inward bending a belt-like piece extended from the box part 510 forwardly.

The box part 510 is provided on the female terminal to receive the reaction force applied from the spring piece 520, to protect an interference with the spring piece 520 from the exterior, to lock the box part 510 with a housing of the connector housing when received in the connector housing, and so on.

In the above-mentioned female terminal, the box part 510 and the spring piece 520 are integrally formed with each other by press working a single piece of metal plate. Therefore, the female terminal brings in some problems in which the yield ratio of the metallic material is low to create a material cost, and the mold and the process of press working is complicated to create any costs.

SUMMARY OF THE INVENTION

In view of the above-mentioned circumstances, an object of the invention is to provide a female terminal for decreasing a material cost and a working cost.

An aspect of the present invention provides a female terminal for receiving a male terminal, the female terminal including: a tubular box part having a receiving portion for receiving the male terminal therein; a spring piece which includes a fixed end provided inside the box part, and a free end pinching the male terminal between the spring piece and the box part by an elastic reaction force of the spring piece, wherein the spring piece is made of a metal as a separate member from the box part.

In the female terminal, the box part may be made of resin.

In the female terminal, the fixed end of the spring piece may be embedded into the box part.

The female terminal may further include a metallic terminal piece which pinches the male terminal between the spring piece and the terminal piece, and the terminal piece may include a connection portion exteriorly projected from the receiving portion of the box part for connecting to an electric wire.

In the female terminal, the terminal piece may include a projecting portion which is larger in width than the connection portion, and the box part may include a slit for receiving the projecting portion of the terminal piece.

In the female terminal, the spring piece may be integrally formed with a metallic terminal piece for connecting to an electric wire, and a portion of the terminal piece may be embedded into the box part.

In the female terminal, the spring piece may be integrally formed with a metallic terminal piece for connecting to an electric wire, and the terminal piece may be constructed to be press-fitted to the box part.

In the female terminal, a plurality of the box parts for receiving respective male terminals may be provided so that adjacent box parts are connected to each other in parallel.

In the female terminal, the box part may be made of a metal, a slit may be formed on a side wall of the box part, and the fixed end of the spring piece may be projected to be engaged with the slit thereby assembling the spring piece into the box part.

In the female terminal, the slit may be defined by a curved surface and an opposed surface, and an intermediate portion of the slit may be made narrower than both end portions of the slit.

According to the above configuration, the spring piece is manufactured as a single metallic piece and assembled into the box part. Thus, the material cost and the working cost can be decreased in comparison with a case where a single metallic plate is press-worked to manufacture the box part and the spring piece. Further, at least the spring piece is made of a metal, so the male terminal is pinched by a large elastic reaction force of the spring piece.

According to the above configuration, since the box part is made of resin ceramics, the material cost and the working cost can be greatly decreased. Further, since the box part is made of resin lighter in weight than a metal, reduction of the female terminal in weight can be achieved. In a case where the box part is made of resin, adjacent box parts are connected to each other in parallel thereby integrating a plurality of the female terminals into one component. In such a case, it is unnecessary to provide an individual cavity for inserting each terminal on a connector housing. Thus, the configuration of the connector housing can be simplified. Further, the connector housing may be omitted depending on some cases, and the cost and expense can be decreased by a drastic simplification of the configuration.

According to the above configuration, the fixed end of the spring piece is embedded into the box part. The configuration is made by, for example, insert-molding process of the box part by filling resin into the mold to which the fixed end of the spring piece is set.

According to the above configuration, since the metallic terminal piece is press-fitted into the box part to pinch the male terminal between the terminal piece and the spring piece, high durability is ensured in comparison with a case where the male terminal is pinched by the resin wall of the box part and the spring piece. Since the connection portion for electrically connecting to an electric wire is provided on a portion of the terminal piece exteriorly projected from the receiving portion of the box part, it is easy to connect to the electric wire.

According to the above configuration, since the box part includes a slit for receiving the projecting portion of the terminal piece which is larger in width of the connection portion, the terminal piece is easily press-fitted into the box part along the slit.

According to the above configuration, the spring piece is integrally formed with the metallic terminal piece, a portion of the terminal piece is set in the mold, and the box part is insert-molded so that the portion of the terminal piece is embedded into the box part. Thus, the configuration can be simplified in comparison with a case where the spring piece and the terminal piece are prepared separately. Further, because the insert molding process is applied in these cases, the assembling process can be also simplified.

According to the above configuration, since the metallic terminal piece integrally formed with the spring piece is press-fitted on the resin box part, the forming cost is suppressed in comparison with a case where the terminal piece is set in the mold to insert-mold the box part.

According to the above configuration, since a plurality of the box parts made of resin are connected, the connector can be simply assembled.

According to the above configuration, the slit is formed on a side wall of the box part, and the fixed end of the spring piece is projected to be engaged with the slit thereby assembling the spring piece into the box part. Thus, even if the box part is made of a metal, it is possible to decrease the working cost and all expenses.

According to the above configuration, the shape of the slit is constructed so that the projection of the spring piece is smoothly inserted into the slit, and that the spring piece is hardly withdrawn from the slit once the projection is engaged with the rear end portion.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein:

FIG. 1A is an external perspective view; FIG. 1B is a perspective view taken from line Ib-Ib of FIG. 1A; and FIG. 1C is an exploded perspective view;

FIG. 3A is a partial perspective view of a terminal piece; and FIG. 3B is a development view of the terminal piece;

FIG. 5A is an external perspective view of the female terminal; and FIG. 5B is a perspective view taken from line Vb-Vb of FIG. 5A;

DETAILED DESCRIPTION OF THE PREFERRED EMBODIMENTS

Embodiments of the present invention will be described in detail with reference to the accompanying drawings.

First Embodiment

Figure 1A:
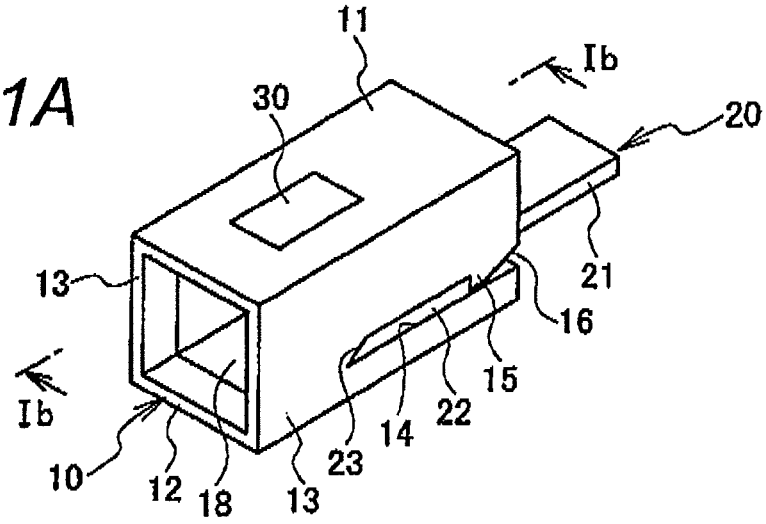
FIGS. 1A to 1C show a configuration of a female terminal according to a first embodiment of the invention.
Figure 1B:
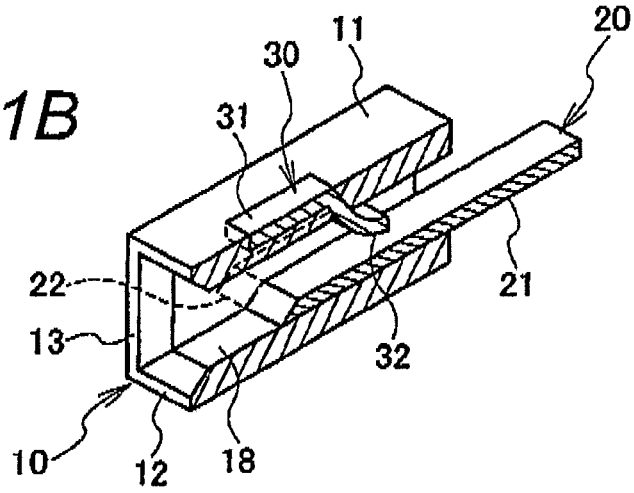
Figure 1C:
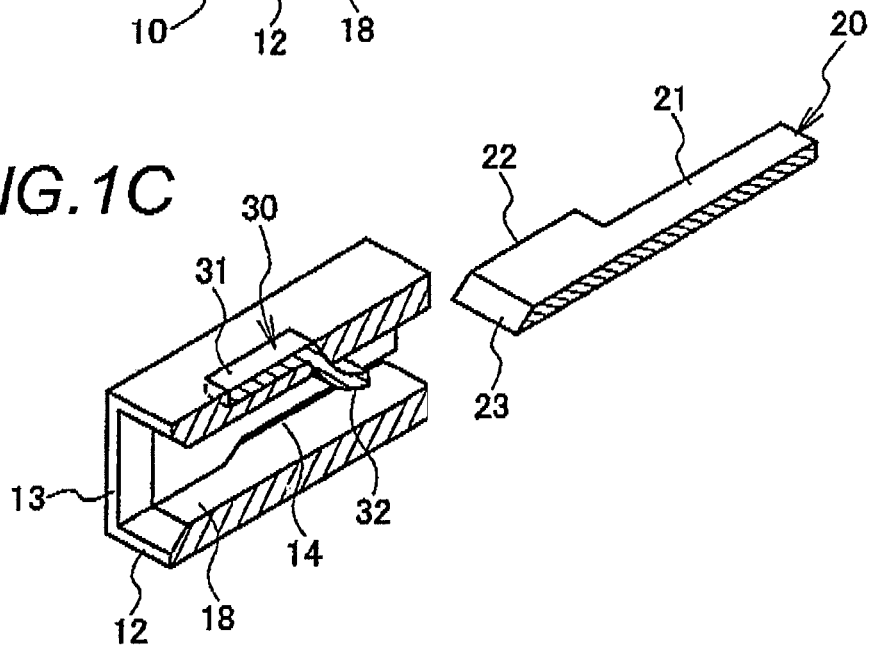

FIGS. 1A to 1C show a configuration of a female terminal according to a first embodiment of the invention: FIG. 1A is an external perspective view; FIG. 1B is a perspective view taken from line Ib-Ib of FIG. 1A; and FIG. 1C is an exploded perspective view.

The female terminal includes a tubular box part 10, a spring piece 30 and a belt-like metallic terminal piece 20. The box part 10 includes an insertion hole (a receiving portion) 18 for receiving a male terminal (not shown) from a front end of the box part 10. The spring piece 30 is provided inside the box part 10 to pinch the male terminal inserted from the front end of the box part 10 between an inner wall of the box part 10 and the spring piece 30 by an elastic reaction force. The terminal piece 20 is press-fitted into the box part 10 so as to oppose to the spring piece 30. The inserted male terminal is pinched between the terminal piece 20 and the spring piece 30.

The spring piece 30 is manufactured as a single metallic piece, and arranged inside the box part 10. In this case, the box part 10 is made of resin ceramics in which a fixed end 31 of the spring piece 30 is set in a mold to be insert-molded. A free end 32 of the spring piece 30 projects in an insertion hole 18 of the box part 10.

The box part 10 is formed into a cornered tubular shape including an upper wall 11, a lower wall 12, and side walls 13. The terminal piece 20 is press-fitted into an upper surface of the lower wall 12. Press-fitting slits 14 are formed from the rear end on the side walls 13 of the box part 10 to press-fit projecting pieces 22 provided on opposite wings of the terminal piece 20 into the press-fitting slits 14, thereby attaching the terminal piece 20 onto the box part 10. In this case, an engagement wall 15 is provided at an entrance of each of the press-fitting slits 14 to prevent the withdrawal of the press-fitted projecting piece 22 of the terminal piece 20. On an entrance side of the engagement wall 15, an inclining guide portion 16 is provided to easily press-fit the projecting piece 22 of the terminal piece 20. An inclined surface 23 is provided at an apex of the terminal piece 20 for easily press-fitting. A connection portion 21 for electrically connecting to an electric wire is provided on a portion of the terminal piece 20 exteriorly projected from the insertion hole 18 of the box part 10.

In order to manufacture the female terminal, firstly, the metallic spring piece 30 and terminal piece 20 are manufactured as a single piece, respectively. The spring piece 30 is a small piece formed into a simple geometry including the fixed end 31 and the free end 32. The spring piece 30 is easily formed by a press-working. Further, since the terminal piece 20 has a simple structure including a projecting piece 22 provided on front opposite wings of the belt plate, the terminal piece 20 is easily manufactured by punching a metallic flat plate.

Next, the spring piece 30 is set in the mold, and the box part 10 is insert-molded by filling resin into the mold. Subsequently, the terminal piece 20 is press-fitted into the press-fitting slit 14 from the rear end of the box part 10. Accordingly, the manufacture of the female terminal is completed.

When the male terminal is inserted into the box part 10 of the female terminal, the male terminal proceeds inside the box part 10 while press-fitting and deforming the spring piece 30. When the male terminal proceeds at a predetermined position, the male terminal is pinched between the free end 32 of the spring piece 30 and the terminal piece 20 by an elastic reaction force of the spring piece 30. Then, the male terminal is electrically connected to the terminal piece 20 of the female terminal.

According to the female terminal of the first embodiment, the spring piece 30 is manufactured as a single metallic piece (i.e. as a separate member from the box part 10) and assembled into the box part 10. Thus, the material cost and the working cost can be decreased in comparison with a case where a single metallic plate is press-worked to manufacture the box part and the spring piece. Especially, since the box part 10 is made of resin ceramics, the material cost and the working cost can be greatly decreased. Further, since the box part 10 is insert-molded by using the spring piece 30, simplification of the assembling process can be achieved. Since the box part 10 is made of resin lighter in weight than a metal, reduction of the female terminal in weight can be achieved. Because the spring piece 30 is made of metal, the male terminal is pinched by a large elastic reaction force.

Since the belt-like metallic terminal piece 20 is press-fitted into the box part 10 to pinch the male terminal between the terminal piece 20 and the spring piece 30, high durability is ensured in comparison with a case where the male terminal is pinched by the resin wall of the box part 10 and the spring piece 30. Since the connection portion 21 for electrically connecting to an electric wire is provided on a portion of the terminal piece 20 exteriorly projected from the insertion hole 18 of the box part 10, it is easy to connect to the electric wire.

In a case where the box part 10 is made of resin, adjacent box parts 10 are easily connected to each other in parallel while ensuring an insulating performance, and a plurality of the female terminals are integrated in one component. When the box parts 10 are multiple-connected, it is unnecessary to provide an individual cavity for inserting each terminal on a connector housing. Thus, the configuration of the connector housing can be simplified. Further, the connector housing may be omitted depending on some cases, and the cost and expense can be decreased by a drastic simplification of the configuration.

Second Embodiment

Figure 2:
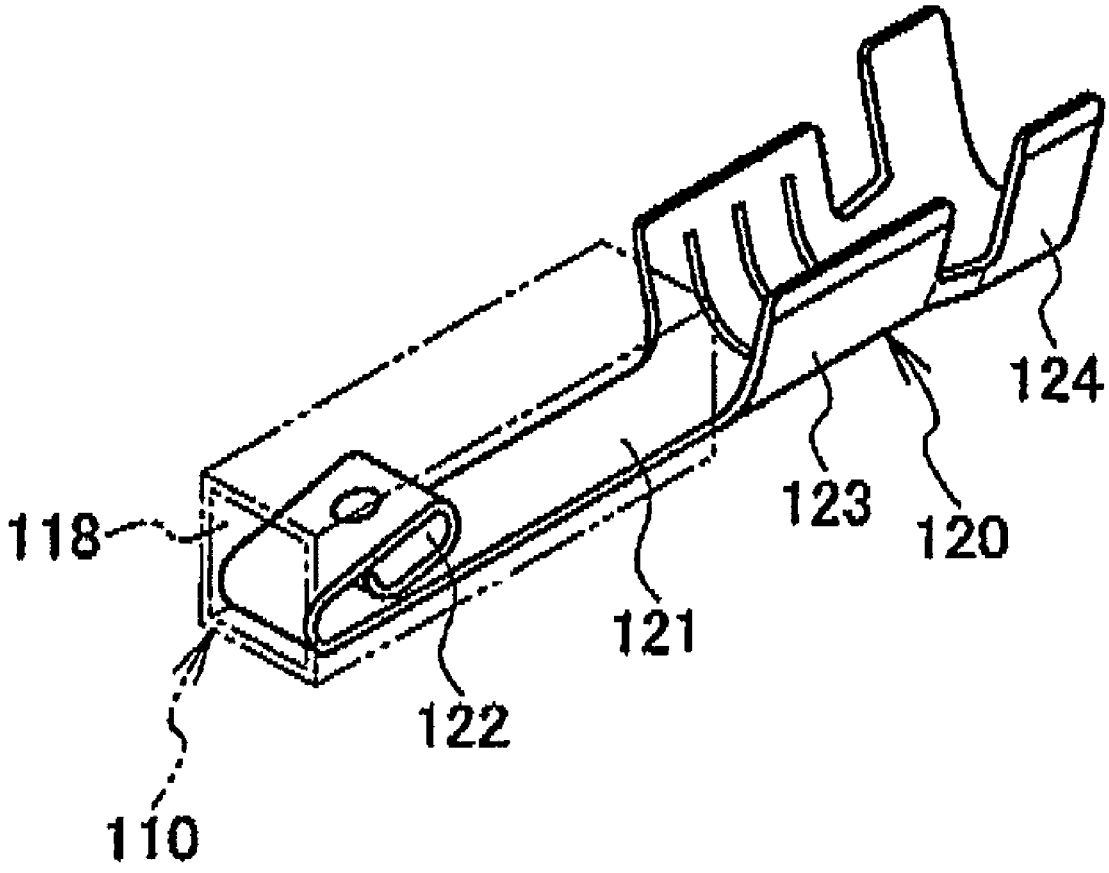
FIG. 2 is a perspective view schematically showing a configuration of a female terminal according to a second embodiment of the invention.

FIG. 2 is a perspective view schematically showing a configuration of a female terminal according to a second embodiment of the invention.

The female terminal includes a tabular resin-made box part 110 and a metallic terminal piece 120 to be assembled to the box part 110. The box part 110 includes an insertion hole 118 for receiving a male terminal (not shown) from a front end of the box part 110. The terminal piece includes a spring piece 122 provided inside the box part 110 to pinch the male terminal inserted from the front end of the box part 110 between an inner wall of the box part 110 and the spring piece 122 by an elastic reaction force.

Figure 3A:
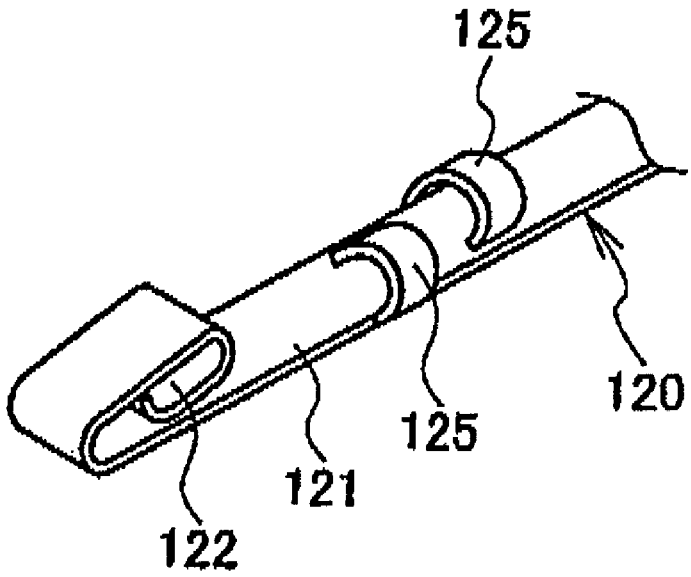
FIGS. 3A and 3B show a modified example according to the second embodiment.
Figure 3B:
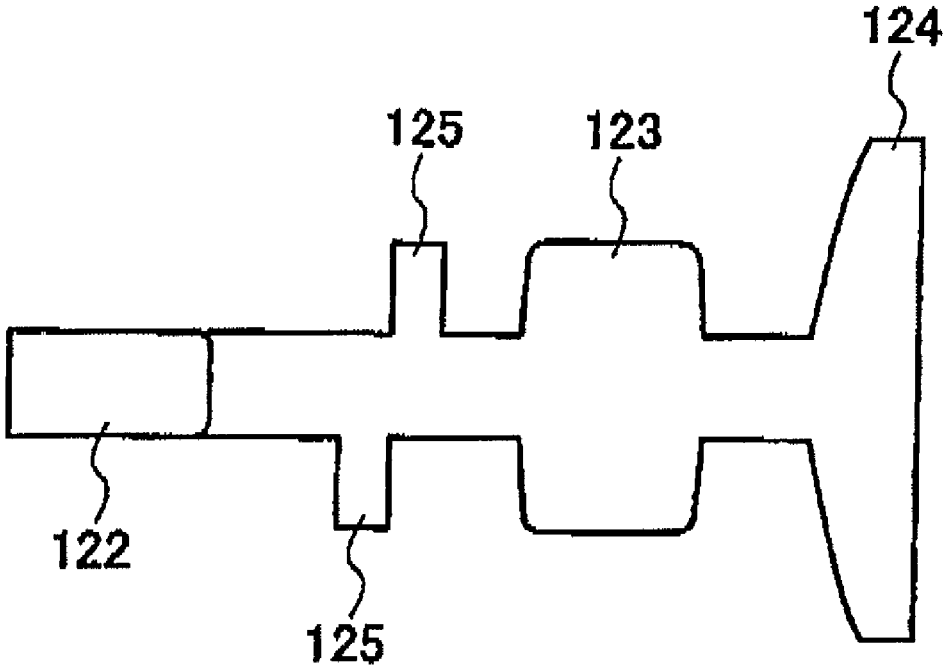

The terminal piece 120 includes the spring piece at an apex of a belt-like base plate 121, and a conductor crimping piece 123 and a sheath crimping piece 124 as a wire connection portion at a rear side of the base plate 121. An intermediate portion with respect to a longitudinal direction of the base plate 121 of the terminal piece 120 is set into a mold to insert-mold the box part 110. Thus, the box part 110 and the terminal piece 120 are integrated together. In this event, on a potion of the terminal piece 120 to be embedded into the resin configuring the box part 110, projecting pieces may be provided as shown in a partial perspective view of FIG. 3A and a development view of FIG. 3B. Thus, the resin-made box part 110 and the terminal piece 120 are firmly integrated together.

In order to manufacture the female terminal, firstly, the metallic terminal piece 120 is manufactured as a single piece by a metal plate, to include the spring piece 122 at the apex of the terminal piece 120, and the conductor crimping piece 123 and the sheath crimping piece 124 at the rear side of the terminal piece 120. In this case, the terminal piece 120 is easily formed by a press-working because it is unnecessary to provide the box part 110 with the terminal piece 120 integrally.

Next, a portion of the terminal piece 120 is set in the mold, and the box part 10 is insert-molded by filling resin into the mold. Thus, the terminal piece 120 and the box part 110 are integrated together and the spring piece 122 is exposed to project inside the insertion hole 118 of the box part 110.

When the male terminal is inserted into the box part 110 of the female terminal as manufactured, the male terminal proceeds inside the box part 110 while press-fitting and deforming the spring piece 122. When the male terminal proceeds at a predetermined position, the male terminal is pinched between the spring piece 122 and an inner wall of box part 110 by an elastic reaction force of the spring piece 122. Then, the male terminal is electrically connected to the terminal piece 120 of the female terminal.

That is, a portion of the spring piece 122 connected to the base plate serves as a fixed end embedded into the box part 110 with the base plate 121, and a remaining portion of the spring piece 122 serves as a free end to apply an elastic reaction force on the inserted male terminal.

According to the female terminal of the second embodiment, the terminal piece 120 including the spring piece 122 is manufactured as a single metallic piece and assembled into the box part 110. Thus, the material cost and the working cost can be decreased in comparison with a case where a single metallic plate is press-worked to manufacture the box part and the spring piece. Especially, since the box part 110 is made of resin ceramics, the material cost and the working cost can be greatly decreased. Further, since the box part 110 is insert-molded by using the terminal piece 120 including the spring piece 122, simplification of the assembling process can be achieved. Since the box part 110 is made of resin lighter in weight than a metal, reduction of the female terminal in weight can be achieved. Because the spring piece 122 is made of metal, the male terminal is pinched by a large elastic reaction force. Further, since the conductor crimping piece 123 and the sheath crimping piece 124 are provided at the rear side of the terminal piece 120 as a wire connection portion, it is easy to connect to the electric wire.

Figure 4:
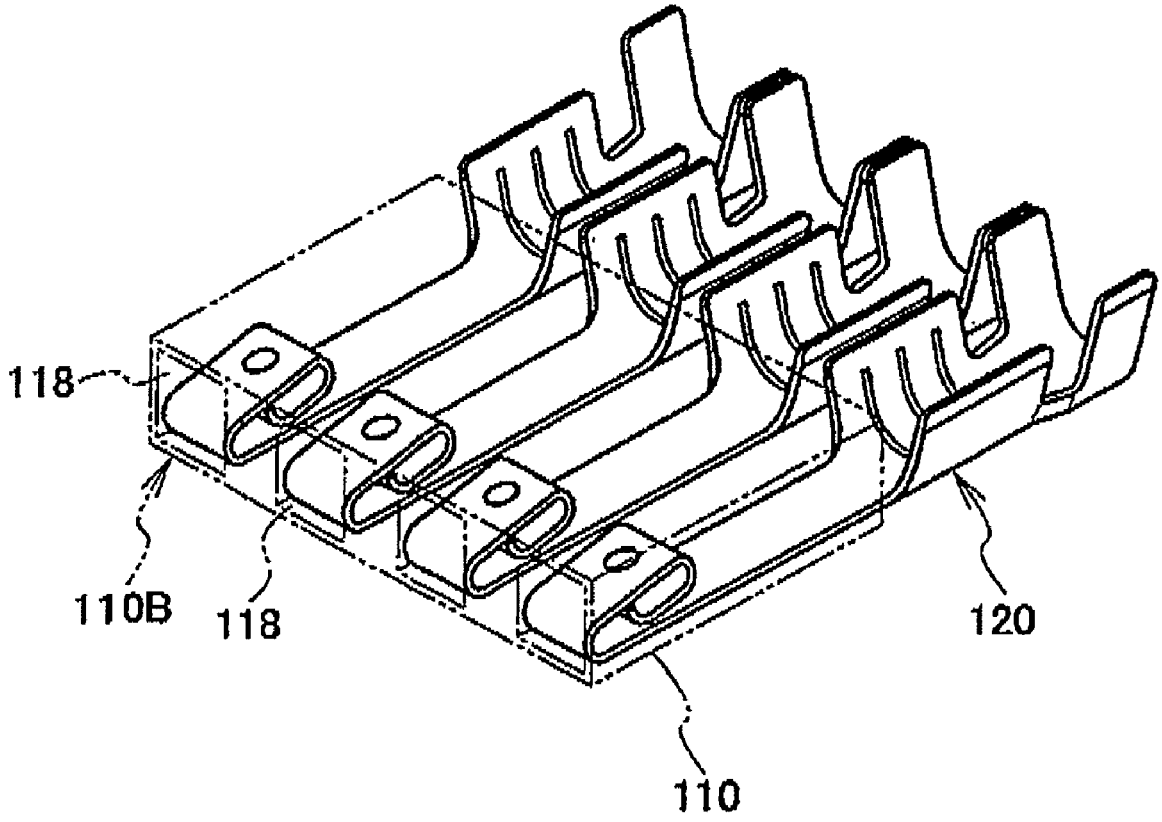
FIG. 4 is a perspective view of an applied example according to the second embodiment.

In a case where the box part 110 is made of resin, adjacent box parts 110 are easily connected to each other in parallel as shown in FIG. 4 while ensuring an insulating performance, and a plurality of the female terminals are integrated in one component. For example, if a resin housing 110B is previously provided to include a plurality of box parts 110 to be integrally formed, and the terminal pieces 120 are set in the box parts 110 of the housing 110B, respectively, multiple-connected female terminals can be constructed.

When the box parts 110 are multiple-connected, it is unnecessary to provide an individual cavity for inserting each terminal on a connector housing. Thus, the configuration of the connector housing can be simplified. Further, the connector housing may be omitted depending on some cases, and the cost and expense can be decreased by a drastic simplification of the configuration.

In the above embodiment, the box part 110 is obtained to be insert-molded by setting the terminal piece 120 in the mold. Alternatively, the box part may be firstly molded in a separate member, and thereafter, the terminal piece 120 including the spring piece 122 may be press-fitted in the resin box part 110.

Third Embodiment

Figure 5A:
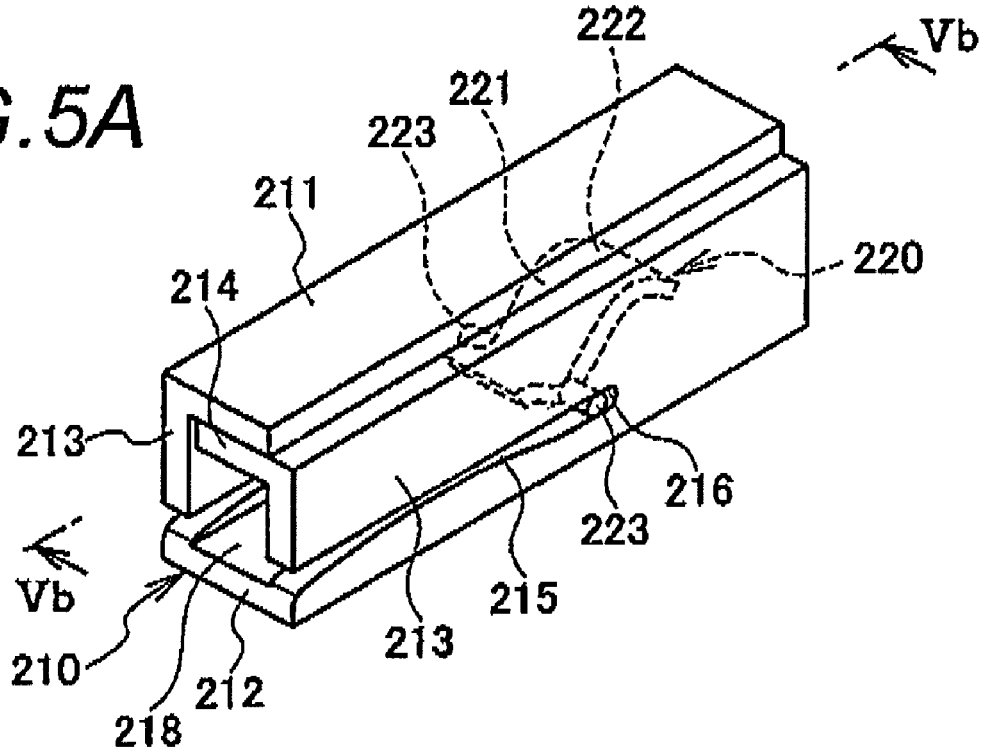
FIGS. 5A and 5B show a configuration of a female terminal according to a third embodiment of the invention.
Figure 5B:
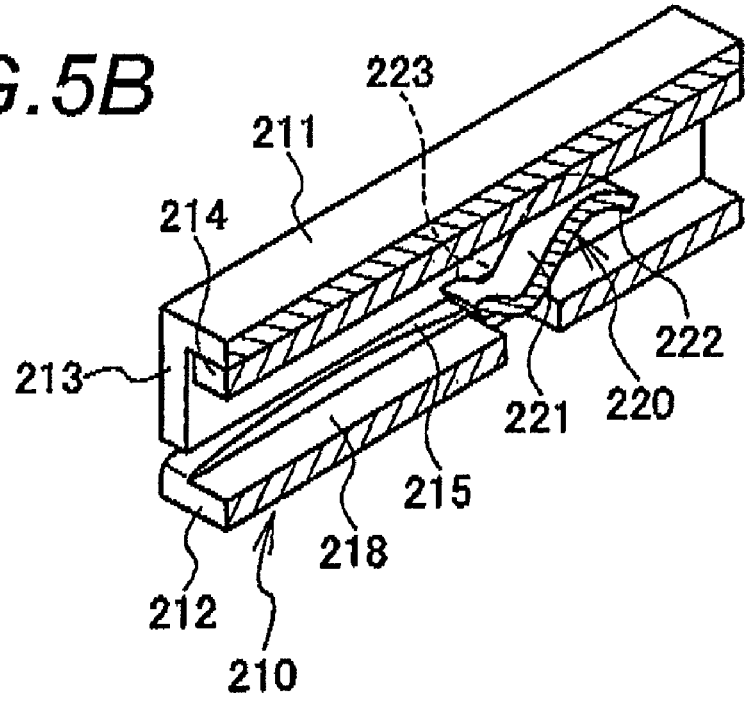
Figure 6:
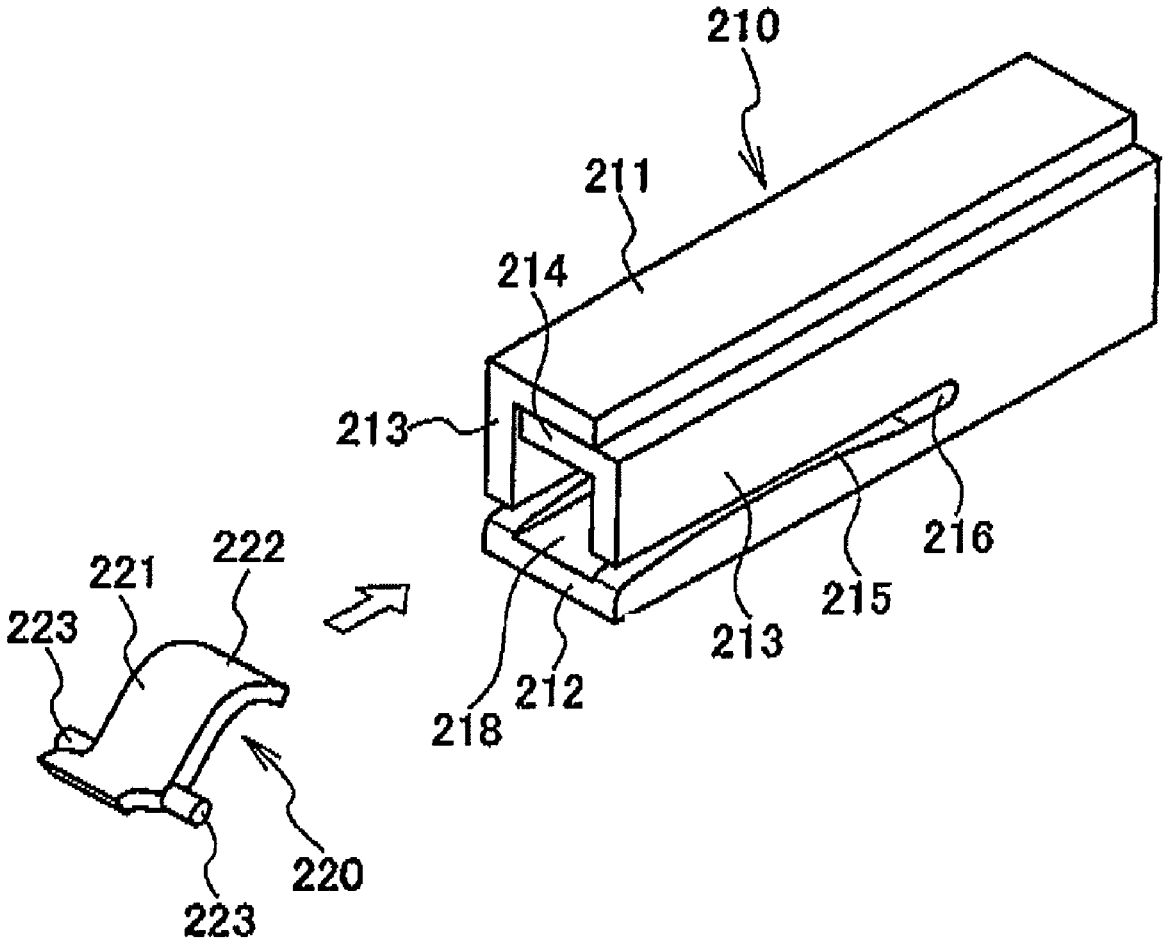
FIG. 6 is a perspective view showing a state where a spring piece is assembled into a box part when the female terminal is constructed according to the third embodiment.
Figure 7:
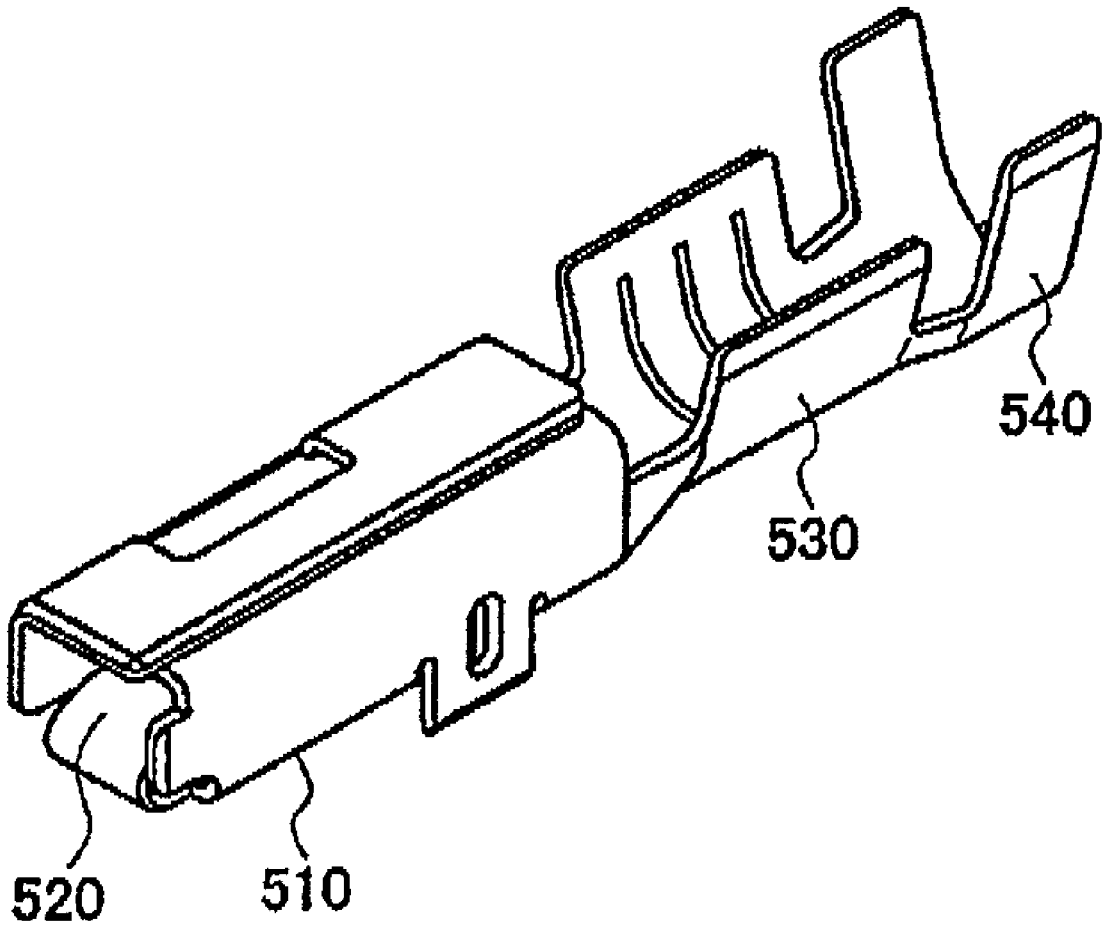
FIG. 7 Prior Art
FIG. 7 is a perspective view showing one example of a related female terminal.

FIGS. 5A and 5B show a configuration of a female terminal according to a third embodiment of the invention: FIG. 5A is an external perspective view of the female terminal; and FIG. 5B is a perspective view taken from line Vb-Vb of FIG. 5A. FIG. 6 is a perspective view showing a state where a spring piece is assembled into a box part when the female terminal is constructed according to the third embodiment.

The female terminal includes a tubular box part 210 and a spring piece 220 provided inside the box part 210. The box part 210 includes an insertion hole 218 for receiving a male terminal (not shown) from a front end of the box part 210. The spring piece 220 pinches the male terminal inserted from the front end of the box part 210 between an inner wall of the box part 210 and the spring piece 220 by an elastic reaction force.

The spring piece 220 is manufactured as a single metallic piece, and arranged inside the box part 210. The box part 210 is manufactured as a single metallic piece as well.

The box part 210 is formed into a cornered tubular shape including upper walls 211, 214, a lower wall 212, and side walls 213. Slits 215 are formed from a front end on the side walls 213 along a longitudinal direction of the box part 210. The spring piece 220 includes a belt plate 221 bent in a wave shape, projections 223 at the opposite sides, and a free end 222 to press the male terminal. Each of the projections 223 is inserted from the front end of the box part 210 into the respective one of the slits 215, and is positioned at a rear end portion 216 of the slit 215 to be engaged, thereby assembling the spring piece 220 into the box part 210.

That is, the projection 223 engaged with the rear end portion 216 of the slit 215 serves as a fixed end of the spring piece 220. Further, as shown in FIGS. 5A and 5B, the slit 215 is defined by a continually curved lower surface and a straight upper surface of the side wall 213. An intermediate portion of the slit 215 is made narrower than both end portions (i.e. the front end portion and the rear end portion 216). Accordingly, the projection 223 of the spring piece 220 is smoothly inserted into the slit 215, and once the projection 223 is engaged with the rear end portion 216, the spring piece 220 is hardly withdrawn from the slit 215. In such a case, the shape of the slit 215 (i.e. the shapes of the surfaces defining the slit 215) is not limited thereto as far as the projection 223 can be inserted into the slit 215 to be engaged.

In order to manufacture the female terminal, firstly, the metallic box part 210 and spring piece 220 are manufactured as a single piece, respectively. Since the box part 210 has a simple cornered tubular shape, and has no spring pieces integrally formed, the box part 210 is easily formed by a press-working. Further, since the spring piece 220 is a small piece formed into a simple geometry including the belt plate 221 bent in a wave shape and the projection 223 at the opposite sides, the spring piece 2200 is easily formed by a press-working.

Subsequently, the projection 223 of the spring piece 220 is inserted into the slit 215 of the box part 210, and engaged with the rear end portion 216 at a predetermined position. Accordingly, the manufacture of the female terminal is completed.

When the male terminal is inserted into the box part 210 of the female terminal, the male terminal proceeds inside the box part 210 while press-fining and deforming the spring piece 220. When the male terminal proceeds at a predetermined position, the male terminal is pinched between the spring piece 220 and an inner wall of the box part 210 by an elastic reaction force of the spring piece 220. Then, the male terminal is electrically connected to the female terminal.

According to the female terminal of the third embodiment, the spring piece 220 is manufactured as a single metallic piece and assembled into the box part 210. Thus, the material cost and the working cost can be decreased in comparison with a case where a single metallic plate is press-worked to manufacture the box part and the spring piece. Further, the projections 223 projected from the opposite sides of the spring piece 220 are engaged with the slits 215 formed from the front end on the side walls 213 of the box part 210 to assemble the spring piece 220 into the box part 210. According to the configuration, the spring piece 220 can be assembled into the box part 210 after completely working the box part 210, and it is possible to decrease the working cost and all expenses.

The entire of the box part 210 is not always made of a metal as far as the connection portion is ensured for connecting to an electric wire. For example, the side wall portion including the slit 215 may be made of a resin.

What is claimed is:

1. A female terminal for receiving a male terminal, the female terminal comprising:

a tubular box part consisting of resin, having a receiving portion for receiving the male terminal therein;

a spring piece fixed at only one end, which includes a fixed end provided inside the box part, and a free end pinching the male terminal between the spring piece and the box part by an elastic reaction force of the spring piece, wherein the spring piece is made of a metal as a separate member from the box part, and the fixed end of the spring piece is embedded into the box part by insert molding.

2. The female terminal according to claim 1, wherein the spring piece is integrally formed with a metallic terminal piece for connecting to an electric wire, and wherein a portion of the terminal piece is embedded into the box part.

3. The female terminal according to claim 1, wherein a plurality of the box parts for receiving respective male terminals are provided so that adjacent box parts are connected to each other in parallel.

4. The female terminal according to claim 1, further comprising a metallic terminal piece which pinches the male terminal between the spring piece and the terminal piece, wherein the terminal piece includes a connection portion exteriorly projected from the receiving portion of the box part for connecting to an electric wire.

5. The female terminal according to claim 4, wherein the terminal piece includes a projecting portion which is larger in width than the connection portion, and wherein the box part includes a slit for receiving the projecting portion of the terminal piece.

6. The female terminal according to claim 1, wherein the fixed end of the spring piece is embedded into a box part of one inner surface of the box part by insert-molding.

7. A female terminal for receiving a male terminal, the female terminal comprising:

a tubular box part made of resin, having a receiving portion for receiving the male terminal therein;

a spring piece fixed at only one end, which includes a fixed end provided inside the box part, and a free end pinching the male terminal between the spring piece and the box part by an elastic reaction force of the spring piece; and a metallic terminal piece which pinches the male terminal between the spring piece and the terminal piece, wherein the terminal piece includes a connection portion exteriorly projected from the receiving portion of the box part for connecting to an electric wire, wherein the spring piece is made of a metal as a separate member from the box part, and wherein the fixed end of the spring piece is embedded into the box part.

8. The female terminal according to claim 7, wherein the terminal piece includes a projecting portion which is larger in width than the connection portion, and wherein the box part includes a slit for receiving the projecting portion of the terminal piece.

9. The female terminal according to claim 7, wherein the spring piece is integrally formed with a metallic terminal piece for connecting to an electric wire, and wherein the terminal piece is constructed to be press-fitted to the box part.

10. A female terminal for receiving a male terminal, the female terminal comprising:

a tubular box part made of resin, having a receiving portion for receiving the male terminal therein;

a spring piece fixed at only one end, which includes a fixed end provided inside the box part, and a free end pinching the male terminal between the spring piece and the box part by an elastic reaction force of the spring piece, wherein the spring piece is made of a metal as a separate member from the box part, wherein the fixed end of the spring piece is embedded into the box part, wherein the spring piece is integrally formed with a metallic terminal piece for connecting to an electric wire, and wherein a portion of the terminal piece is embedded into the box part.

* * * * *